US005755114A

United States Patent [19]

Foglietta

[11] Patent Number: 5,755,114

[45] Date of Patent: May 26, 1998

[54] USE OF A TURBOEXPANDER CYCLE IN LIQUEFIED NATURAL GAS PROCESS

[75] Inventor: Jorge Hugo Foglietta, Missouri City, Tex.

[73] Assignee: ABB Randall Corporation, Houston, Tex.

[21] Appl. No.: 779,043

[22] Filed: Jan. 6, 1997

[51] Int. Cl.[6] ..... F25J 3/00

[52] U.S. Cl. ..... 62/618; 62/621; 62/912

[58] Field of Search ..... 62/618, 621, 912

[56] References Cited

U.S. PATENT DOCUMENTS

| | | | |
|---|---|---|---|
| 3,362,173 | 1/1968 | Kuerston | 62/9 |
| 3,548,606 | 12/1970 | Kuerston | 62/9 |
| 3,818,714 | 6/1974 | Etzbach et al. | 62/11 |
| 4,225,329 | 9/1980 | Bailey et al. | 62/24 |
| 4,334,902 | 6/1982 | Paradowski | 62/9 |
| 4,445,916 | 5/1984 | Newton | 62/621 X |
| 4,970,867 | 11/1990 | Herron et al. | 62/11 |
| 5,139,548 | 8/1992 | Liu et al. | 62/24 |
| 5,351,491 | 10/1994 | Fabian | 62/621 |
| 5,414,188 | 5/1995 | Ha et al. | 585/800 |
| 5,473,900 | 12/1995 | Low | 62/9 |
| 5,486,227 | 1/1996 | Kumar et al. | 95/41 |
| 5,505,048 | 4/1996 | Ha et al. | 62/11 |
| 5,535,594 | 7/1996 | Grenier | 62/612 |
| 5,568,737 | 10/1996 | Campbell et al. | 62/621 |

*Primary Examiner*—Christopher Kilner
*Attorney, Agent, or Firm*—Charles D. Gunter, Jr.

[57] ABSTRACT

A process is shown for producing liquefied natural gas from a pressurized natural feed stream. The feed stream is introduced into heat exchange contact with a mechanical refrigeration cycle to cool the feed stream to a first cooling temperature. At least a portion of the feed stream is passed through a turboexpander cycle to provide auxiliary refrigeration for the mechanical refrigeration cycle to thereby cool the feed stream to a second, relatively lower cooling temperature.

10 Claims, 1 Drawing Sheet

USE OF A TURBOEXPANDER CYCLE IN LIQUEFIED NATURAL GAS PROCESS

BACKGROUND OF THE INVENTION

1. Field of the Invention

The present invention relates generally to a process for the liquefication of natural gas and, specifically, to the use of turboexpanders to augment the mechanical refrigeration effect utilized in such a process for the liquefaction of such a natural gas.

2. Description of the Prior Art

The liquefaction of natural gas is an important and widely practiced technology to convert the gas to a form which can be transported and stored readily and economically. There are numerous reasons for the liquefaction of gases and particularly of natural gas. Perhaps the chief reason is that the liquefaction greatly reduces the volume of a gas, making it feasible to store and transport the liquefied gas in containers of improved economy and design.

These economies are apparent, for example, when considering gas being transported by pipeline from a source of supply to a distant market. In these circumstances, it is desirable to operate under a high load factor. In practice, however, capacity may exceed demand at one time or demand may exceed capacity at another time. It would be desirable to supplement such systems when demand exceeds supply by supplying additional material from a storage source. For this purpose, it is desirable to provide for the storage of gas in a liquefied state and to vaporize the liquid as demand requires.

The liquefaction of natural gas is also important in those situations where gas is to be transported from a source of plentiful supply to a distant market, particularly if the source of supply cannot be directly joined to the market by a gas pipeline. In some cases the method of transport is by ocean going vessels. It is uneconomical to transport gaseous materials by ship unless the gaseous materials are highly compressed. Even then the transport would not be economical because of the necessity of providing containers of suitable strength and capacity. It is therefore most desirable to store and transport natural gas by first reducing the natural gas to a liquefied state by cooling the gas to a temperature in the range from about −240° F. to −260° F. and atmospheric pressure.

A number of prior art references teach processes for the liquefication of natural gas in which the gas is liquefied by passing it sequentially through a plurality of cooling stages to cool the gas to successively lower temperatures until the liquefaction temperature is reached. Cooling is generally accomplished in such systems by indirect heat exchange with one or more refrigerants such as propane, propylene, ethane, ethylene, and methane which are expanded in a closed refrigeration loop. Additionally, the natural gas is expanded to atmospheric pressure by passing the liquefied gas through one or more expansion stages. During the course of the expansion, the gas is further cooled to a suitable storage or transport temperature and is pressure reduced to approximately atmospheric pressure. In this expansion to atmospheric pressure, significant volumes of natural gas may be flashed. The flashed vapors may be collected from the expansion stages and recycled or burned to generate power for the liquid natural gas manufacturing facility.

Many liquefied natural gas (LNG) liquefaction plants utilize a mechanical refrigeration cycle for the cooling of the inlet gas stream of the cascaded or mixed refrigerant type such as is disclosed, e.g., in issued U.S. Pat. No. 3,548,606, issued Dec. 22, 1970, and assigned to Phillips Petroleum Company. The cascaded refrigeration cycle type plants are expensive to build and maintain and the mixed refrigerant cycle plants require close attention of stream compositions during operation. Refrigeration equipment is particularly expensive because of the low temperature metallurgy requirements of the components.

Therefore, it would be desirable to develop a liquefaction process which is less expensive than the traditional cascaded or mixed refrigerant systems.

It would also be desirable to provide an improved process for the liquefaction of natural gas which features a hybrid design which combines a turboexpander cycle with mechanical refrigeration to efficiently and economically liquefy natural gas.

Specifically, it would be desirable to provide a process in which a mechanical refrigeration cycle provides refrigeration at the high temperature end of the process while a turboexpander cycle is provided to furnish refrigeration at the relatively lower temperature end of the process.

SUMMARY OF THE INVENTION

It is, therefore, an object of the present invention to provide a more economical process for the liquefication of natural gas.

Another object of the present invention is to provide an improved process which utilizes a turboexpander cycle loop in a natural gas liquefaction process to augment a mechanical refrigeration cycle which provides a more economical and efficient liquid natural gas manufacturing process than the prior art cascaded refrigeration cycles.

In accordance with the present invention, there is provided a process for producing liquefied natural gas from a pressurized natural gas feed stream in which the feed stream is introduced into heat exchange contact with a mechanical refrigeration cycle to cool the feed stream to a first cooling temperature. At least a portion of the feed stream is passed through a turboexpander cycle to provide auxiliary refrigeration for the mechanical refrigeration cycle to thereby cool the feed stream to a second, relatively lower cooling temperature.

Preferably, the feed stream is a pressurized lean natural gas feed stream which is predominantly methane and has an initial pressure above about 800 psig. The resulting liquefied natural gas stream has its pressure reduced in a flash vessel subsequent to the refrigeration step to thereby produce a liquefied natural gas product stream and an overhead gaseous stream. Preferably, the overhead gaseous stream is recycled to provide additional refrigeration to the process before being recombined with the feed stream entering the mechanical refrigeration cycle. A portion of the recycled overhead gaseous stream from the flash vessel can be diverted for fuel usage in the process. The liquefied natural gas stream which exits the flash vessel is at about atmospheric pressure and at a temperature of about −240° F. to −260° F.

In the preferred embodiment, the turboexpander cycle includes a turboexpander for reducing the pressure of the feed gas stream and for extracting useful work therefrom during the pressure reduction, the turboexpander also producing an effluent stream. The turboexpander effluent is passed to a separator or distillation column which separates the effluent into a heavy liquid stream which subsequently is expanded to provide further refrigeration to the process and a gas stream which is also used for a further refrigeration effect. Both the expanded heavy liquid stream and the gas stream from the separator or column are passed in indirect heat exchange contact with the entering feed gas stream. The gas stream exiting the separator or column is compressed after passing an indirect heat exchange contact with the entering feed gas stream and a subsequently recycled and combined with the feed gas stream entering the process. The gas stream which exits the separator or column can be compressed by means of a compressor which is driven by the work obtained from the turboexpander.

Additional objects, features and advantages will be apparent in the written description which follows.

DETAILED DESCRIPTION OF THE INVENTION

Figure 1:
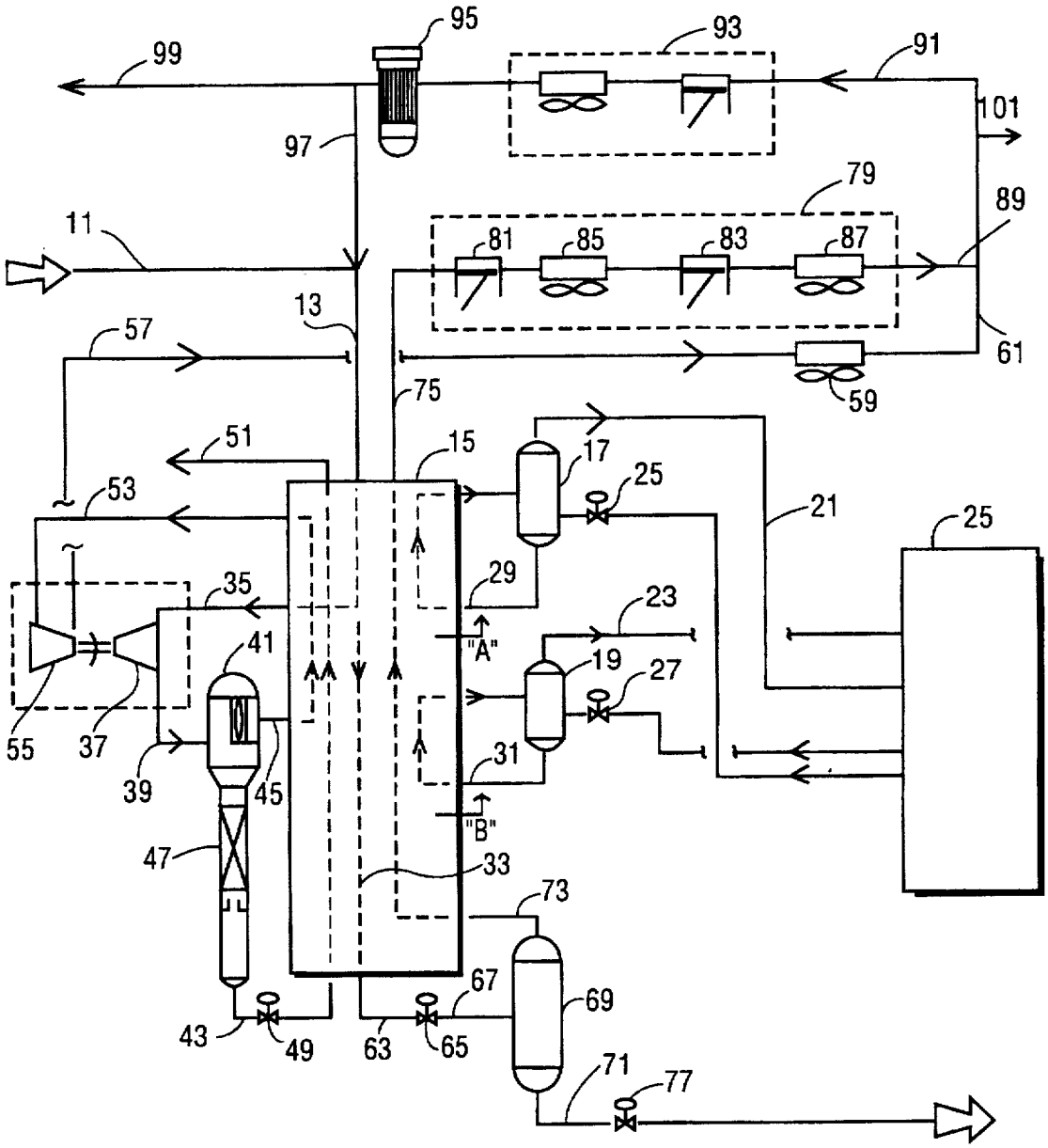
FIG. 1 shows a simplified flow diagram of a liquefaction process according to the present invention.

The detailed description of the invention will be made with reference to the liquefaction of a lean natural gas and specific reference will be made to the liquefaction of a lean natural gas having an initial pressure above about 800 psig, the gas being at ambient temperature. Preferably, the lean natural gas will have an initial pressure of about 900–1000 psig at ambient temperature. In this discussion, the term "lean natural gas" will be taken to mean a gas that is predominantly methane, for example, 85% by volume methane with the balance being ethane, higher hydrocarbons and nitrogen.

Referring now to FIG. 1 of the drawings, the pressurized lean natural gas feed stream at ambient temperature is introduced to the process through a feed stream line 11. In the embodiment illustrated, the feed gas stream is at a pressure of about 1000 psig and ambient temperature. The feed gas stream has been pre-treated to remove acid gases such as carbon dioxide, hydrogen sulfide, and the like, by known methods such as desiccation, amine extraction, or the like. The feed stream 11 is also typically pre-treated in a dehydrator unit of conventional design to remove the water from the natural gas stream. In accordance with conventional practice, water is removed to prevent freezing and plugging of the lines and heat exchangers at the temperature subsequently encountered in the process. Known dehydration techniques include the use of gas desiccants such as molecular sieves.

The pre-treated feed gas stream 11 passes through the conduit 13 to the refrigeration section of the liquid natural gas manufacturing facility. In the refrigeration section 15, the feed gas stream is cooled by heat exchange contact with a closed loop propane or propylene refrigeration cycle to cool the feed stream to a first cooling temperature. The mechanical refrigeration effect achieved in the refrigeration section 15 is typically supplied by a cascade refrigeration cycle, such as that discussed with reference to the earlier cited Phillips patent. Such cascade refrigeration cycles may have only a single evaporating pressure and compression stage for each refrigerant utilized i.e., methane, ethane, ethylene, propane/propylene. Typically, refrigeration is supplied over many discrete temperatures, however. Any number of cooling stages may be employed, depending upon the composition, temperature and pressure of the feed gas.

In the embodiment of FIG. 1, a simplified closed loop refrigeration cycle is provided by two "THERMOSIPHON" units, commercially available from ABB Randall Corporation of Houston, Tex. The THERMOSIPHON units 17, 19 circulate refrigerant, in this case propane or propylene, within closed loops 21, 23, respectively, between the compression section 25 and the expansion valves 25, 27 of the THERMOSIPHON vessels. Expansion valves 25, 27 produce a cooling effect within the vessels 17, 19, thereby cooling the refrigerant circulated through conduits 29, 31 to produce a refrigeration effect within the refrigeration section 15 of the process. Although the THERMOSIPHON system is illustrated in the preferred embodiment of FIG. 1, any other commercially available mechanical refrigeration system could be utilized, as well.

Conduit 13 branches within the refrigeration section 15 into the downwardly extending conduit 33 and the branch conduit 35. The feed stream passing through the branch conduit 35, presently at about 1000 psig and +15° F., is passed through a turboexpander cycle to provide auxiliary refrigeration for the mechanical refrigeration cycle to thereby cool the feed stream to a second, relatively lower cooling temperature. The turboexpander cycle may consist of a commercially available turboexpander 37, as commonly utilized in industry for let down turbines, the treatment of gases, or in connection with water-based systems, such as will be familiar to those skilled in the art. The turboexpander 37 is utilized in the process of the invention to extract work from the natural gas feed stream during pressure reduction so as to produce an effluent stream 39 which is still predominately gaseous but at a substantially reduced pressure. The resulting effluent will be at a pressure of approximately 200 psig and at a reduced temperature typically below about −150° F.

The turboexpander effluent stream 39 is passed to a separator or column 41 which separates the effluent into a heavy liquid stream passing out conduit 43 and an overhead gas stream passing out conduit 45. While the separator unit 41 can assume a variety of forms, in the embodiment of FIG. 1 it includes a mass transfer section 47 in which a portion of the liquid is vaporized and sent back up the column to strip out a portion of the lighter components of the entering stream. The heavier components, e.g. propane, exiting through conduit 43 at about −100° F. are expanded through a Joule-Thomson valve 49 and are sent back through the refrigeration section 15 in countercurrent flow to the entering feed stream 13 to provide an additional refrigeration effect. The exit stream 51 from the refrigeration section 15 can be burned in order to, e.g., power compressors used in other parts of the process.

The lighter components exiting the separator through the overhead conduit 45 are similarly passed in countercurrent heat exchange relation to the entering feed gas stream within the refrigeration unit 15 and are then passed through conduit 53 to the booster compressor 55, which in this case is driven by the turboexpander 37. The exiting stream 57 from the compressor 55 passes through a cooler unit 59 and continues out conduit 61.

The combined effect of the mechanical refrigeration cycle and turboexpander cycle provides a refrigeration effect of approximately +15° F. above the heat exchanger cross-section location "A" in the refrigeration section 15 in FIG. 1 and approximately −40° F. below the heat exchanger cross-section location "B" in FIG. 1.

The liquefied natural gas stream exiting the refrigeration section 15 through exit conduit 63 is at about −170° F. and is reduced to a temperature of about −233° F. by means of Joule-Thomson valve 65 or a liquid expander before being passed through conduit 67 to the flash vessel 69. The pressure of the liquefied natural gas stream is reduced within the flash vessel 69 to about 25 psig and a LNG liquid product stream can be drawn off through the discharge conduit 71. The LNG product exiting the flash vessel 69 through conduit 71 passes through Joule-Thomson valve 77 where is it reduced in temperature to about −260° F. and approximately atmospheric pressure and can thereafter be sent to storage.

An overhead gaseous stream 73 is also produced by the flash vessel 69 and is passed in countercurrent heat exchange relation to the incoming feed gas stream within the refrigeration section 15. The overhead gaseous stream 73 is at about −233° F. and is typically on the order of 40% of the LNG product being sent to storage, but may be much less, e.g. 15%, if a two stage flash is utilized with liquid expanders between the flash vessels. At 40% volume, the overhead vapor 73 from the flash vessel or vessels constitutes a significant source of refrigeration for the process.

The overhead gaseous stream exiting the refrigeration section 15 through conduit 75 is at about 20 psig and −5° F. and is sent through a conventional compressor-cooler section 79 having a series of in-line compressors 81, 83 and alternating cooling units 85, 87 to produce an output stream 89 having a pressure which is selected to match the approximate output pressure of the booster compressor 55 of the turboexpander unit, in this case 280 psig. The compressor/cooler arrangement is selected due to the fact that the compressor seals are generally limited to 300° F., necessitating that multiple stage compressor/cooler units must be utilized.

The combined streams in conduits 61 and 89 are routed through return conduit 91 through an additional compressor/cooler stage 93 to boost the pressure to about 1000 psig. The output passes to a compressor oil separator unit 95 to be recombined with the entering feed gas stream by means of branch conduit 97. The other branch 99 can be used, for example to form a dehydration system regeneration gas stream. Some of the gaseous stream 91 can be diverted through conduit 101 to be burned to do additional work in the process. The volumetric flow through the branch conduit 97 is typically on the order of three times the flow of the inlet feed gas through conduit 11.

An invention has been provided with several advantages. The "hybrid" liquefaction cycle of the process of the invention combines a turboexpander cycle with a mechanical refrigeration loop. The propane or propylene mechanical refrigeration loop provides refrigeration at a high temperature end of the process while the turboexpander cycle provides auxiliary refrigeration at the relatively lower temperature end of the cycle. The relatively higher temperature operation of the refrigeration section has the advantage of allowing its construction of cheaper materials. After condensing the inlet feed gas stream, it is flashed to pressure near the final storage pressure with the liquid from the flash vessel being sent to the LNG storage tank. The vapor is recycled through the refrigeration section for an additional refrigeration effect and is then recycled to the inlet of the plant. The turboexpander effluent is sent to a separator or a column to remove heavy liquids that might solidify at lower temperatures. The liquids are also used to provide additional refrigeration to the process by Joule-Thomson expansion. The gas exiting the separator provides refrigeration to the process and is then compressed by the booster compressor, which is driven by the expander. This recompressed stream is finally recycled to the inlet of the plant.

The process of the invention provides a method for producing liquefied natural gas which is more economical than the prior art cascade type mixed refrigerant systems. The process offers simplicity of design and economy of components. It is possible to use only one closed loop refrigeration cycle, rather than multiple cycles using mixed refrigerants. Only a portion, approximately 25% of the duty in the inventive process, comes from the single closed loop refrigeration system. The remainder of the refrigeration effect results from warming up the return streams produced by a combination of expansion of the feed through a turboexpander and Joule-Thomson valve or liquid expander pressure reduction. The vaporization of heavy hydrocarbons furnishes an important additional refrigeration effect in the overall process of the invention. The ability to recover work from the turboexpander allows the reduction of the work requirement of the liquefication process.

While the invention has been shown in only one of its forms, it is not thus limited but is susceptible to various changes and modifications without departing from the spirit thereof.

What is claimed is:

1. A process for producing liquefied natural gas from a pressurized natural gas feed stream, the process comprising the steps of:

introducing the feed stream into heat exchange contact with a mechanical refrigeration cycle to cool the feed stream to a first cooling temperature; and passing at least a portion of the feed stream through a turboexpander cycle to provide auxiliary refrigeration for the mechanical refrigeration cycle to thereby cool the feed stream to a second, relatively lower cooling temperature.

2. The process of claim 1, wherein the feed stream is a pressurized lean natural gas feed stream which is predominantly methane and has an initial pressure above about 800 psig.

3. A process for producing liquefied natural gas from a pressurized natural gas feed stream, the process comprising the steps of:

introducing the feed stream into heat exchange contact with a mechanical refrigeration cycle to cool the feed stream to a first cooling temperature; and passing at least a portion of the feed stream through a turboexpander loop to provide auxiliary refrigeration for the mechanical refrigeration cycle to thereby cool the feed stream to a second, relatively lower cooling temperature and condense the feed stream to produce a liquefied natural gas stream;

reducing the pressure of the liquefied natural gas stream in a flash vessel to produce a liquefied natural gas product stream and an overhead gaseous stream;

compressing the overhead gaseous stream; and recycling the compressed overhead gaseous stream to be combined with the feed stream entering the mechanical refrigeration cycle.

4. The process of claim 3, wherein a portion of the recycled overhead gaseous stream from the flash vessel after undergoing at least some compression is diverted for fuel usage in the process.

5. A process for producing liquefied natural gas from a pressurized lean natural gas feed stream which is predominantly methane and has an initial pressure above about 800 psig, the process comprising the steps of:

introducing the feed stream into heat exchange contact with a mechanical refrigeration cycle to cool the feed stream to a first cooling temperature;

passing at least a portion of the feed stream through a turboexpander step to provide auxiliary refrigeration for the mechanical refrigeration cycle to thereby cool the feed stream to a second, relatively lower cooling temperature and condense the feed stream to produce a liquefied natural gas stream;

reducing the pressure of the liquefied natural gas stream in a flash vessel to produce a liquefied natural gas product stream and an overhead gaseous stream;

compressing the overhead gaseous stream;

recycling the compressed overhead gaseous stream to be combined with the feed stream entering the mechanical refrigeration cycle;

wherein the turboexpander step includes a turboexpander for reducing the pressure of the feed gas stream and for extracting useful work therefrom during the pressure reduction, the turboexpander also producing an effluent stream;

passing the turboexpander effluent to a separator or column which separates the effluent into a heavy liquid stream which subsequently is expanded to provide further refrigeration to the process and a gas stream which is also used for further refrigeration effect, both the expanded heavy liquid stream and the gas stream from the separator or column being passed in indirect heat exchange contact with the entering feed gas stream.

6. The process of claim 5, wherein the gas stream exiting the separator or column is compressed after passing in indirect heat exchange contact with the entering feed gas stream and is subsequently recycled and combined with the feed gas stream entering the process.

7. The process of claim 6, wherein the gas stream exiting the separator or column is compressed by means of a compressor which is driven by the work obtained from the turboexpander.

8. The process of claim 7, wherein the heavy liquid stream exiting the separator or column is expanded by Joule-Thomson expansion to provide further refrigeration to the process.

9. The process of claim 8, wherein the liquefied natural gas stream exiting the flash vessel is at about atmospheric pressure and at a temperature below about −240 degrees F. to −260 degrees F.

10. The process of claim 9, wherein the pressurized natural gas feed stream is pre-treated prior to feeding it to the mechanical refrigeration cycle in order to remove carbon dioxide, hydrogen sulfide and water.

* * * * *